US008561424B1

(12) United States Patent
Posciri et al.

(10) Patent No.: US 8,561,424 B1
(45) Date of Patent: Oct. 22, 2013

(54) AIR MOTOR POWER DRIVE SYSTEM

(76) Inventors: Michael Posciri, Anchorage, AK (US); Charles Posciri, Anchorage, AK (US)

( * ) Notice: Subject to any disclaimer, the term of this patent is extended or adjusted under 35 U.S.C. 154(b) by 1339 days.

(21) Appl. No.: 12/283,380

(22) Filed: Sep. 11, 2008

(51) Int. Cl.
*F25B 1/00* (2006.01)
*F01K 23/06* (2006.01)

(52) U.S. Cl.
USPC ..... 62/498; 60/670

(58) Field of Classification Search
USPC ..... 62/401, 417–18, 408, 228.1, 236, 87; 60/669, 670–680; 180/165, 302, 304; 244/53 R; 123/559.1, 565; 297/23 A, 297/23 F, 23 R
See application file for complete search history.

(56) References Cited

U.S. PATENT DOCUMENTS

| | | | | | |
|---|---|---|---|---|---|
| 4,307,573 | A * | 12/1981 | King | ..... | 60/669 |
| 4,738,111 | A * | 4/1988 | Edwards | ..... | 60/671 |
| 4,944,195 | A * | 7/1990 | Takahashi et al. | ..... | 74/409 |
| 5,551,247 | A * | 9/1996 | Manz et al. | ..... | 62/149 |
| 6,948,316 | B2 * | 9/2005 | Minemi et al. | ..... | 60/671 |
| 7,621,253 | B2 * | 11/2009 | Mirabile | ..... | 123/213 |

* cited by examiner

*Primary Examiner* — Khoa Huynh
*Assistant Examiner* — Timothy K Trieu
(74) *Attorney, Agent, or Firm* — Michael J. Tavella

(57) ABSTRACT

Several air motors are powered by a refrigerant that is pressurized to drive an alternator or generator. The electrical output can be used to propel a vehicle or to drive any type of operating system for land, air or sea based systems. The system uses a dual charging system to move pressurized gas that is then injected into an air motor. The gas is then exhausted and condensed back to a liquid. The liquid is stored until it is needed. It is then heated back into a gas, and fed back into the air motor in a continuous cycle. Several of these systems can be installed and connected to a planetary gear system.

12 Claims, 9 Drawing Sheets

AIR MOTOR POWER DRIVE SYSTEM

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to air motor power drive systems and particularly to air motor power drive systems using refrigerant as a medium.

2. Description of the Prior Art

Alternative power systems have been long sought and developed over the last century. Air motors have been used for decades as a simple way to drive systems. Several different designs have been developed that use refrigerants to operate vehicle air conditioners, for example.

BRIEF DESCRIPTION OF THE INVENTION

The instant invention takes the air motor concept to a new level. In this invention, several air motors are powered by a refrigerant that is pressurized. The air motors are connected to a planetary gear system that connects to an alternator or generator. The output can be used to propel a vehicle or to drive any type of operating system for land, air or sea based systems. The preferred load is an alternator or generator because electricity is needed to power the electric motors used in the system. The alternator or generator can serve this purpose directly.

The system uses a dual charging system to move pressurized gas that is then injected into an air motor. The gas is then exhausted and condensed back to a liquid. The liquid is stored until it is needed. It is then heated back into a gas, pressurized and fed back into the air motor in a continuous cycle.

Several of these systems can be installed and connected to a planetary gear system. In one embodiment, the motors operate on a fixed speed basis to drive an alternator. The generator or alternator can supply electricity to a load, or it can be used to power electric drive motors to propel a vehicle.

DETAILED DESCRIPTION OF THE INVENTION

Figure 1:
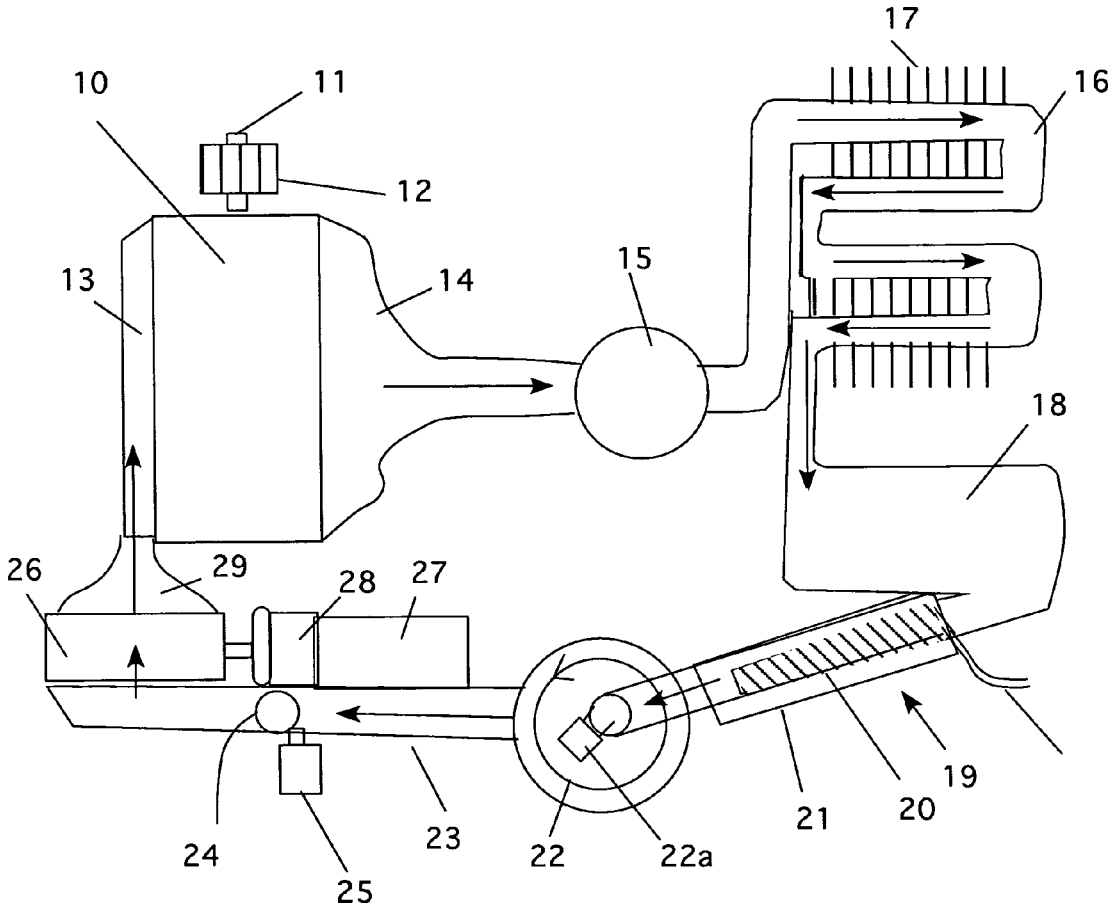
FIG. 1 is a diagrammatic view of one form of the invention.

Referring now to FIG. 1, a diagrammatic view of one form of the invention is shown. In this embodiment 1, an air motor

10 is used to drive an output shaft 11 and accompanying drive gear 12. In the preferred embodiment, the output shaft can be used to drive alternators or generators to power vehicles on land, air or sea, pumps, boat etc. The preferred load is an alternator or generator because electricity is needed to power the electric motors used in the system. The alternator or generator can serve this purpose directly.

The air motor is fed by a unique system that uses refrigerant. The air motor 10 has an intake 13 in which pressurized gas is introduced. This gas passes through the motor, providing energy. The gas exits the motor through the gas exhaust port 14. It then passes through a gas to liquid condenser 15, described below. The gas is passed through pipes in a heat exchanger unit 16 that has cooling fins 17 for cooling. The condensed liquid refrigerant then is stored in a reservoir 18. When the motor needs power, the liquid is passed through an evaporator 19 that has a heating element 20 coiled about a tube (note the leads at the end of the coil that lead to a power supply (see, e.g., FIG. 2). A heat shield 21 contains the heat within the evaporator. Note that although the heater is shown in a horizontal plane, to operate properly, it must be held in a vertical position, with no more than 30 degrees angle from vertical.

The now-evaporated refrigerant gas goes into a centrifugal charger 22, which is a form of supercharger that is powered by an electric motor 22*a* that moves the pressurized gas into a gas transfer pipe 23. A ball control valve 24 is positioned in the transfer pipe, as discussed below. It is operated by an electric motor 25. It operates as a governor, a shut off valve for normal shutdown, and a safety shut off valve for emergency shutdown.

The gas then flows in the constant velocity charger 26 that is powered by an electric motor 27 and gears 28. The constant velocity charger produces a high volume of charged gas through an exhaust port 29 into the air motor intake 13, where the operating cycle begins again. As the air motor is powered, it operates to turn the load for whatever end purpose is desired.

Figure 2:
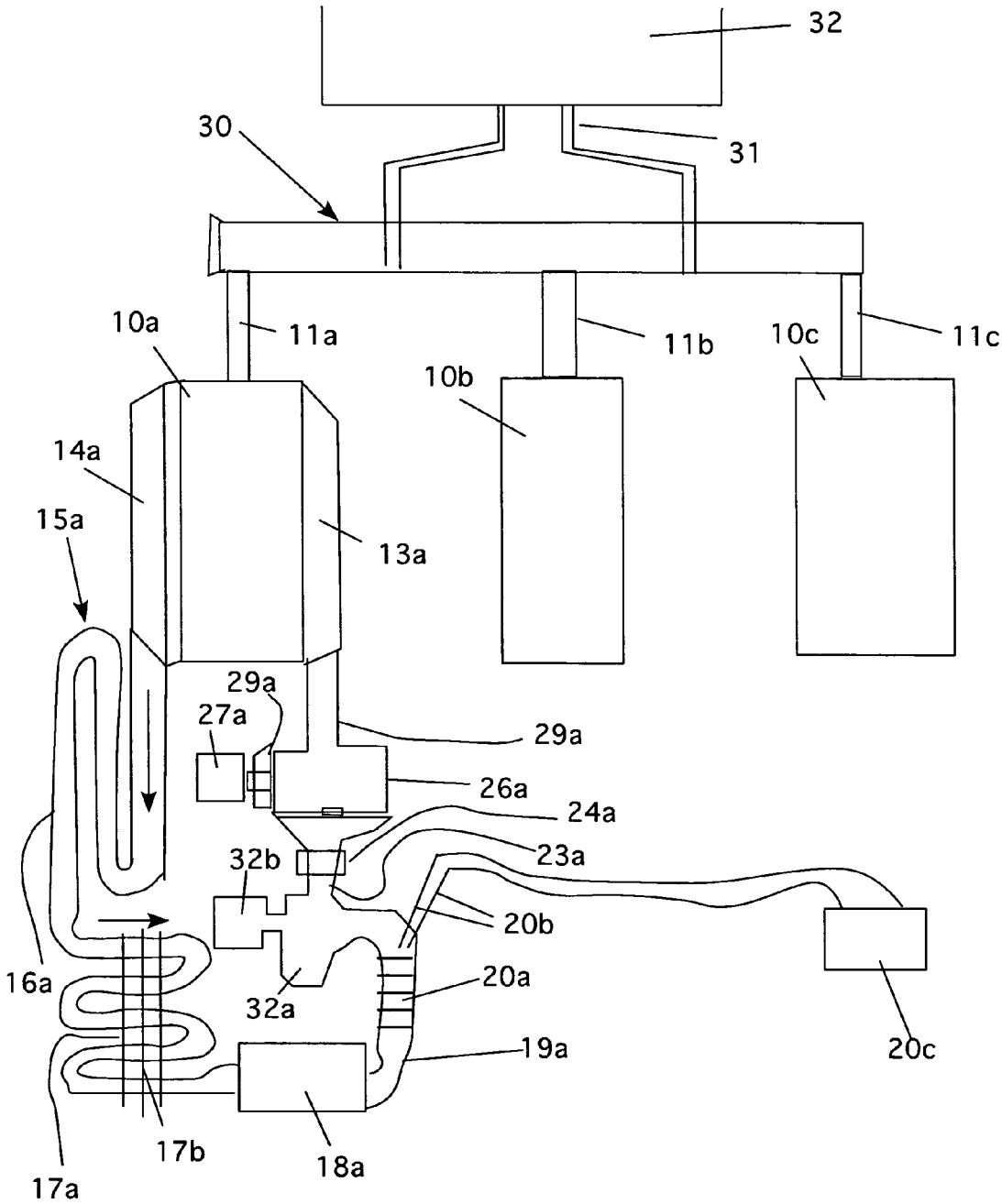
FIG. 2 is a diagrammatic view of a second embodiment of the invention.

FIG. 2 is a diagrammatic view of a second embodiment of the invention. In this embodiment, the system described above is expanded by the addition two or more air motors. The outputs of these motors are fed through a planetary gear system to drive an alternator or generator. Here, the components are shown in a slightly different configuration. Note also that in this figure, three air motors 10*a*, 10*b*, and 10*c* are shown. Each of the motors has an output shaft 11*a*, 11*b*, and 11*c* respectfully, that feed a planetary gear system 30, discussed below. The gear system has a planetary gear carrier 31 that drives an alternator or generator 32.

Note that the system description for air motor 10*a* is identical to that of the other two motors. The components have not been shown for clarity. However, each of the air motor systems shown in FIG. 2 has the same component set-up.

As before, the system begins at the air motor intake 13*a* in which pressurized gas is introduced. The gas exits the motor through the gas exhaust port 14*a*. It then passes through a gas to liquid condenser 15*a*. Here, the gas is passed through a heat exchanger unit 16*a* that has cooling fins 17*a* for cooling. In this embodiment, a directed blower 17*b* can also be used to speed the condensing process.

The condensed liquid refrigerant then is stored in a reservoir 18*a* as before. When the motor needs power, the liquid is passed through an evaporator 19*a* that has electric wires 20*a* coiled about a tube. The connecting wires of the coil 20*b* are fed to a power source, such as a battery and/or the alternator/generator 20*c*.

The now-evaporated refrigerant gas goes into a centrifugal charger 22*a*, which is a form of supercharger that moves the pressurized gas. It is driven by an electric motor 22*b*. It then flows into a gas transfer pipe 23*a* where a flow control valve 24 is positioned. The gas then flows into the constant velocity charger 26*a* that is powered by an electric motor 27*a* and gears 28*a*. The gas exists the charger and into the air motor at high volume, where the operating cycle begins again. As noted above, all of the air motors shown have identical equipment installed and each has an identical operating cycle. As the air motors turn, they produce power output to drive the load, as discussed above.

Figure 3:
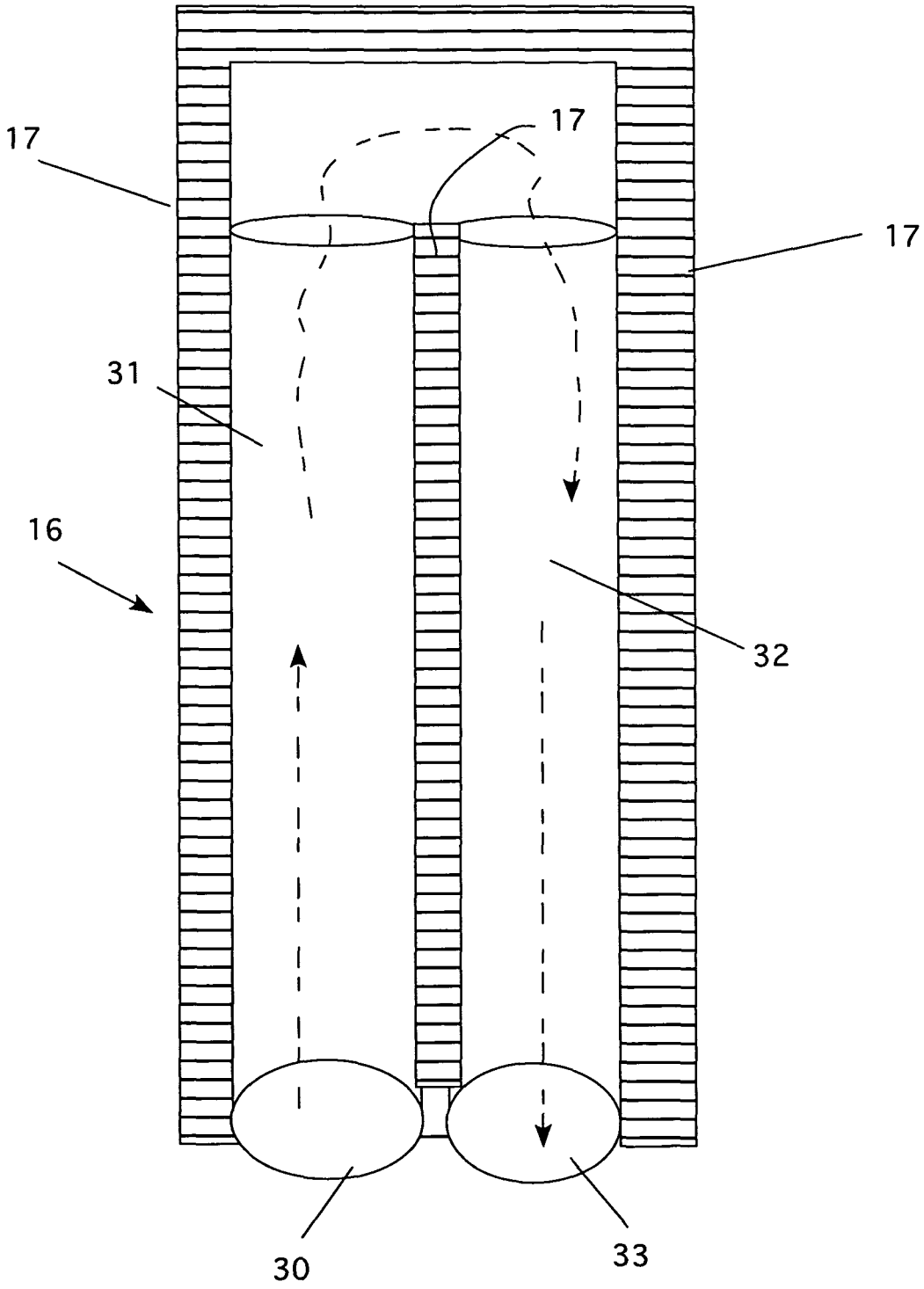
FIG. 3 is a detail view of the gas to liquids condenser unit.

FIG. 3 is a detail view of the gas to liquids condenser unit 16. Note this unit can be any type of condenser, such as a heat exchanger, for example. For the condenser unit shown in the figure, as noted above, the unit must be mounted vertically for the unit to work. As shown in FIG. 1, the gas to liquid condenser has two sets of tubes. Each set has an intake port for the gas 30. Gas flows up in the first pipe 31 and then down the second pipe 32, where it exits as a partial liquid. This configuration is repeated until liquid refrigerant exits the final tube. The liquid then flows into the reservoir. Surrounding each tube are cooling fins 17. The fins run between the pipes as well.

Figure 4:
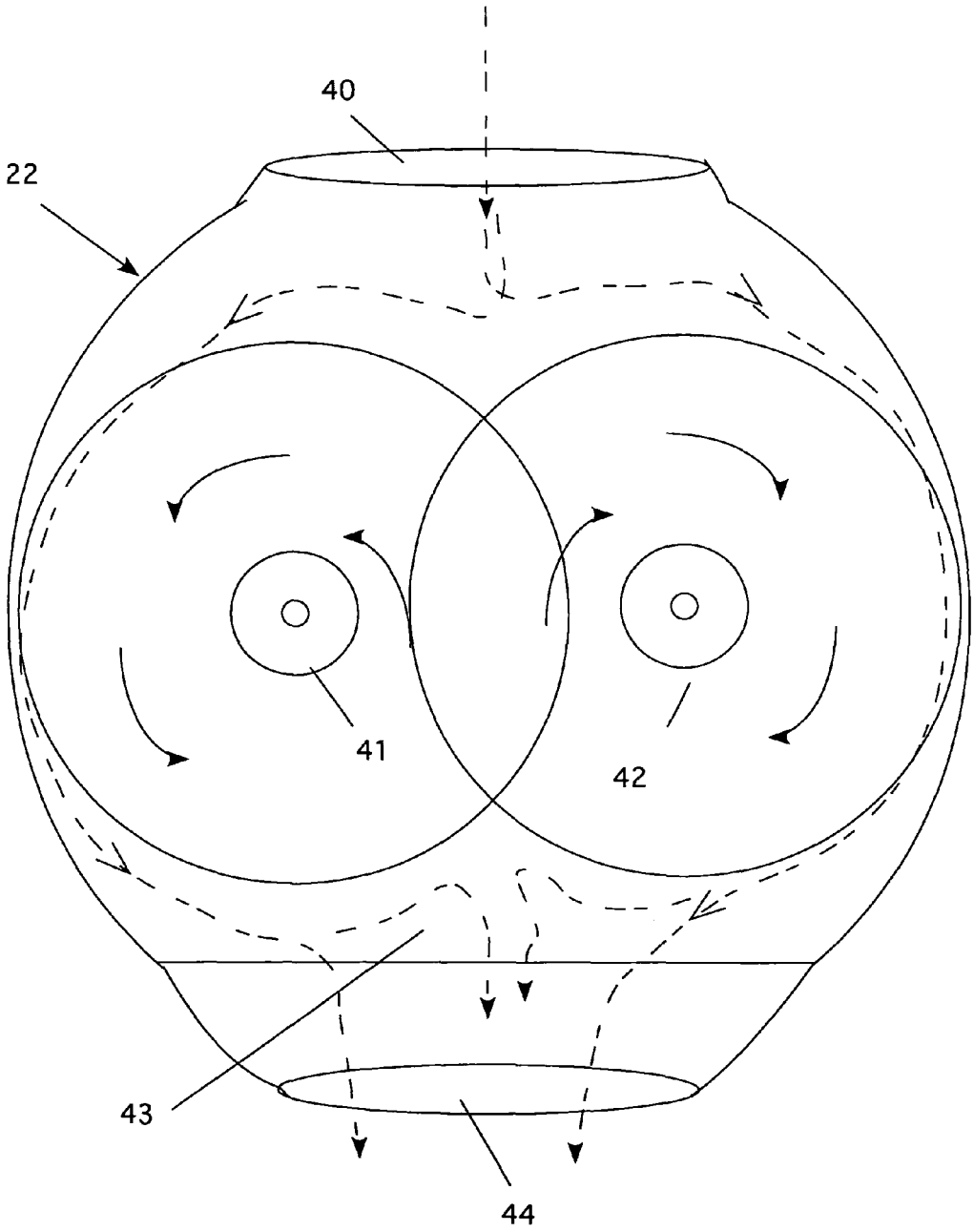
FIG. 4 is a detail view of the constant velocity-high volume charger unit.

FIG. 4 is a detail view of the constant velocity-high volume charger unit 22. Gas from the centrifugal charger enters this unit at the top 40. The unit has two rotors 41 and 42, one of which rotates clockwise and the other rotates counterclockwise (see the arrows). This rotation causes the gas to flow around the rotors from the top of the unit to the bottom of the unit. At the bottom if the unit is a chamber 43, into which the gas collects before it moves out of the exhaust port 44 and into the intake of the air motor. The unit is a displacement pump.

Figure 5:
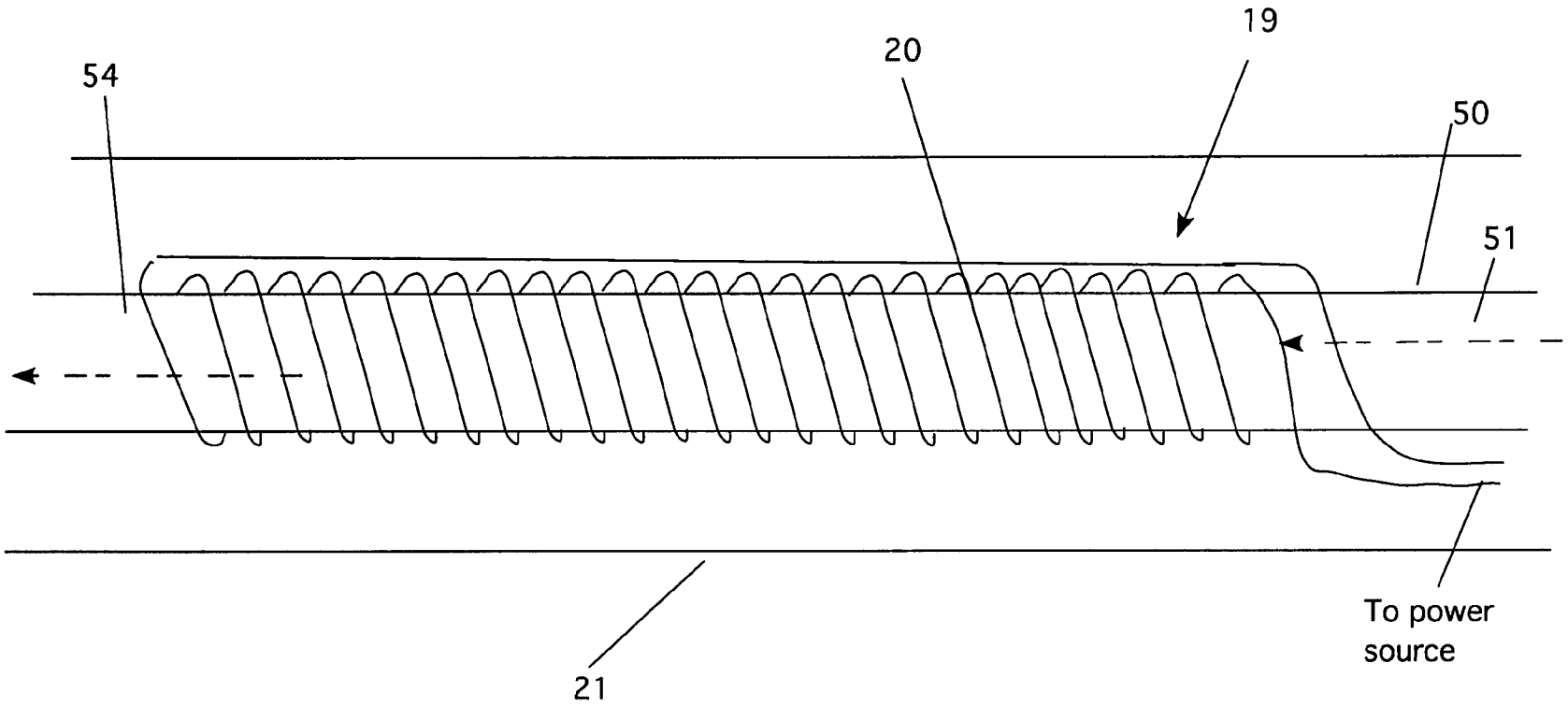
FIG. 5 is a detail view of an evaporator unit.

FIG. 5 is a detail view of an evaporator unit 19. As discussed above, this unit has a central tube 50, through which the liquid enters at the inlet 51. The tube is wrapped with an electric heat coil 20 as shown, which is supplied by a power source, such as a battery (not shown). The tube and coils are encased by a heat deflector shield 21 that maximizes the efficiency of the unit. As the liquid passes through the unit, it evaporates into a gas, which then exits the unit at the outlet port 54.

Figure 6:
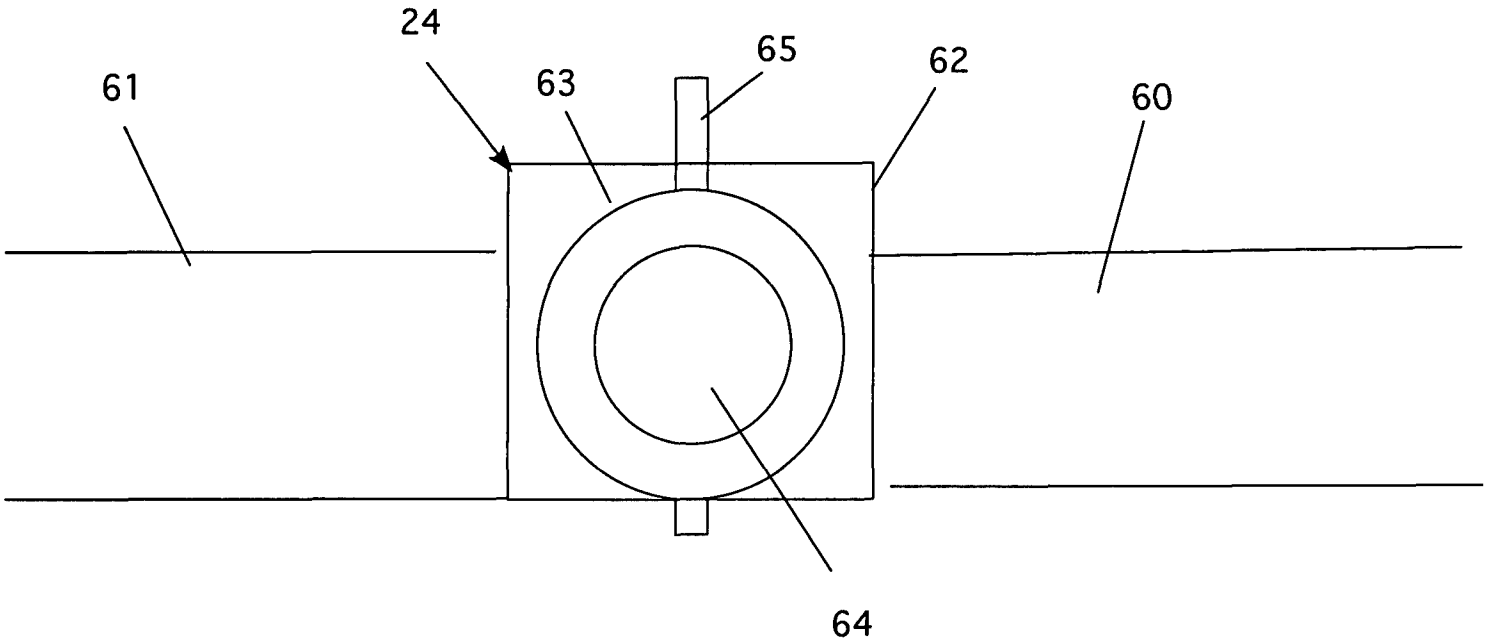
FIG. 6 is a detail view of the flow control ball valve.

FIG. 6 is a detail view of the flow control ball valve 24. The valve is positioned in a line that transfers gas from the centrifugal charger to the constant velocity charger. Gas enters at line 60 and exits from line 61. The valve itself has a housing 62, which contains the ball 63. The ball has a through hole 64 that permits gas to flow when the through hole is aligned with the through pipes and stops flow when the hole is turned perpendicular to the pipes. The ball is controlled by a control shaft 65, which attaches to a motor as discussed above.

Figure 7:
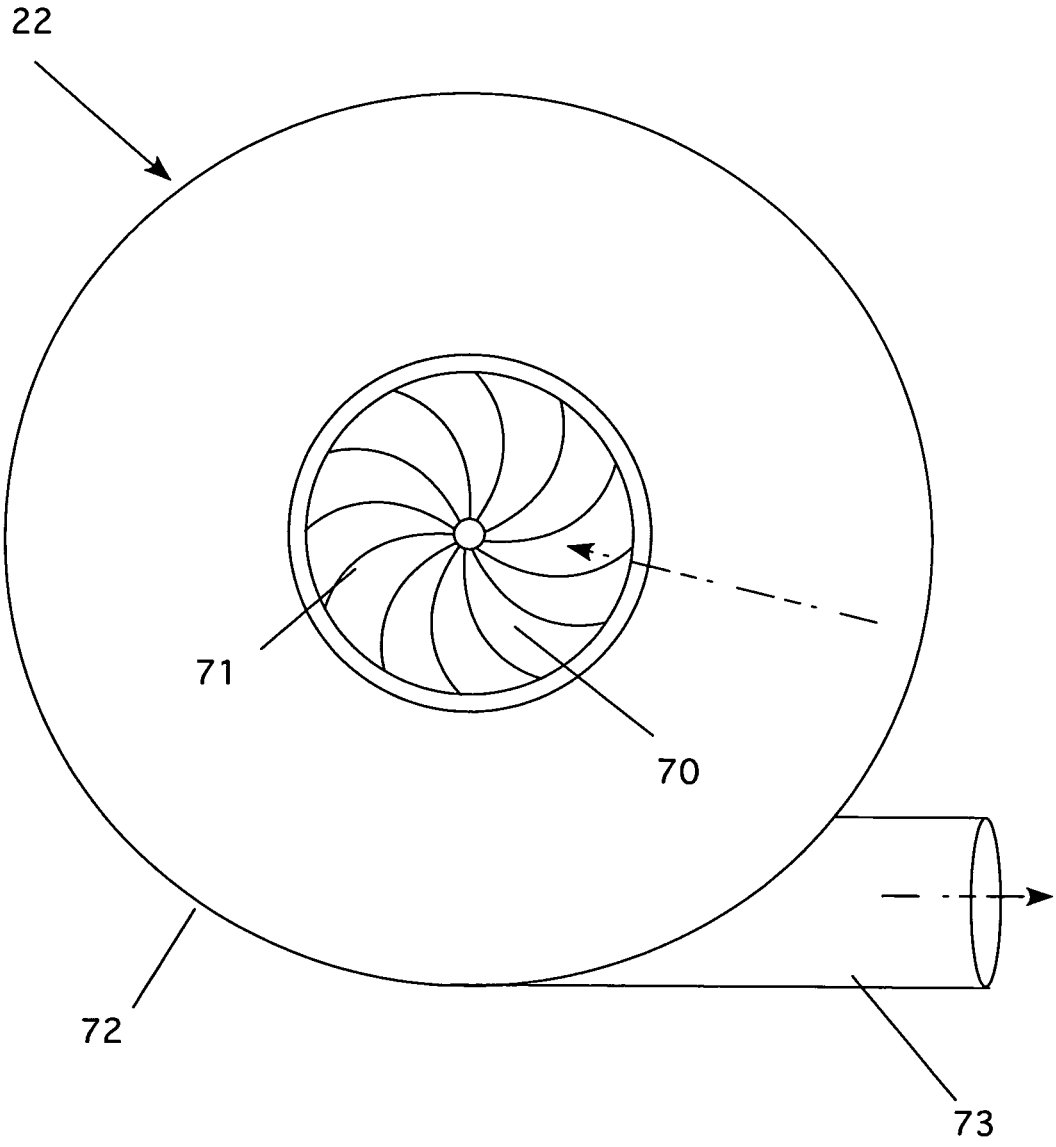
FIG. 7 is a detail view of the centrifugal charger unit.

FIG. 7 is a detail view of the centrifugal charger unit 22. This device is essentially an air ram or supercharger. It has an intake 70 that has a number of fan blades 71 that accelerate the gas as it moves through the unit. The gas is moved around the circular housing 72 until it leaves through the gas outlet 73.

Figure 8:
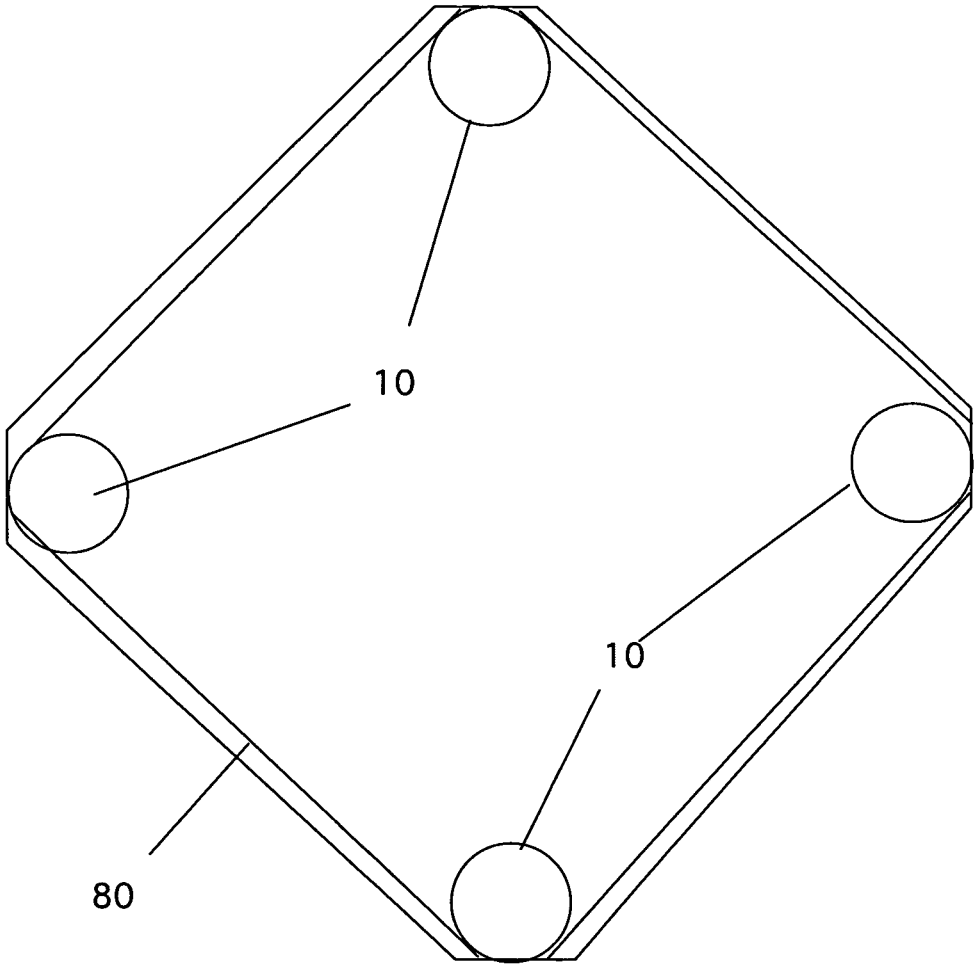
FIG. 8 is a detail view of a frame with four air motors installed.

FIG. 8 is a detail view of a frame with four air motors installed. In this figure, a frame 80 is used to support four air motors 10. The air motors connect to a planetary gear system, as discussed below. The frame is used to support the motors. Note that frames can be designed to hold two or more motors, depending on the output needed and the size of the overall system.

Figure 9:
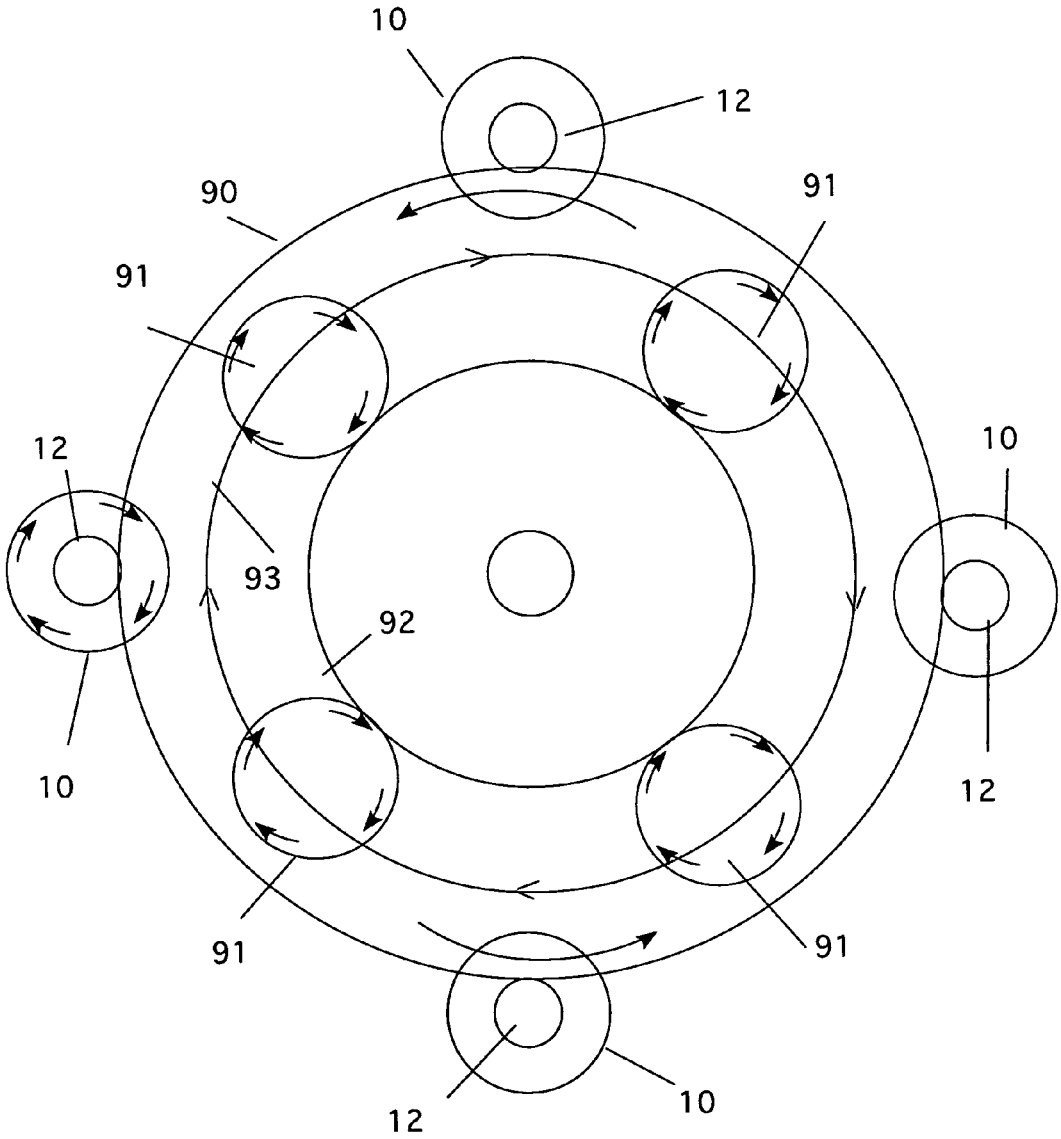
FIG. 9 is a detail view of a planetary gear system for the four air motor configuration.

FIG. 9 is a detail diagrammatic view of a planetary gear system for the four air motor configuration of FIG. 8. Note however, that more motors can be used. Note that the frame is not show. Note also that the gears are shown without teeth for clarity. Of course, the gearing would have standard teeth common to similar gearing systems. The air motors 10 are located at the outer edges of the gear system as shown. In this system, all of the air motors turn clockwise in rotation. Of course, this direction can be reversed if desired. Each air motor has a drive gear 12 that engages the outermost ring gear 90. As shown, the ring gear 90 rotates counterclockwise. The ring gear engages four planetary gears 91, each of which rotates the planetary gear carrier. The planetary carrier has a central shaft 93 that connects to the load.

The use of the planetary gear system allows the outputs of several motors to be coordinated to operate a central shaft. As discussed above, that shaft can operate an alternator or generator.

The use of the air motors being operated by refrigerant provides an economical method of providing power without needing to burn fossil fuels to produce that power.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. An air motor power drive system comprising:

a) an air motor having an output shaft, an intake into which pressurized gas is introduced and a gas exhaust port;

b) a gas to liquid condenser for condensing said pressurized gas into a liquid;

c) a reservoir for storing said liquid;

d) an evaporator attached to said reservoir to convert said liquid into a pressurized gas;

e) a centrifugal charger attached to said evaporator to move the pressurized gas into a gas transfer pipe;

f) a means for controlling the flow of pressurized gas through said gas transfer pipe; and g) a constant velocity charger in operable communication with said gas transfer pipe and said intake on said air motor.

2. The power drive system of claim 1 wherein said output shaft is attached to an electrical producing device selected from the group of alternators or generators.

3. The power drive system of claim 1 wherein said means for controlling the flow of pressurized gas comprises a ball valve.

4. The power drive system of claim 1 wherein said pressurized gas is a refrigerant.

5. The power drive system of claim 1 wherein said output shaft is attached to a planetary gear system.

6. The power drive system of claim 5 wherein said planetary gear system is attached to an electrical producing device selected from the group of alternators or generators.

7. An air motor power drive system comprising:

a) a plurality of air motors, each of said plurality of air motors having an output shaft, an intake into which pressurized gas is introduced and a gas exhaust port;

b) a gas to liquid condenser for condensing said pressurized gas from said exhaust ports into a liquid;

c) a reservoir for storing said liquid;

d) an evaporator attached to said reservoir to convert said liquid into a pressurized gas;

e) a centrifugal charger attached to said evaporator to move the pressurized gas into a gas transfer pipe;

f) a means for controlling the flow of pressurized gas through said gas transfer pipe; and g) a constant velocity charger in operable communication with said gas transfer pipe and the intakes of said plurality of air motors.

8. The power drive system of claim 7 wherein said output shafts of said plurality of air motors is attached to a planetary gear system.

9. The power drive system of claim 7 wherein said means for controlling the flow of pressurized gas comprises a ball valve.

10. The power drive system of claim 7 wherein said pressurized gas is a refrigerant.

11. The power drive system of claim 7 wherein said planetary gear system is attached to an electrical producing device selected from the group of alternators or generators.

12. The power drive system of claim 7 wherein the evaporator includes a heating coil.

* * * * *